US005327593A

United States Patent [19]

Burnett

[11] Patent Number: 5,327,593

[45] Date of Patent: Jul. 12, 1994

[54] DEVICE FOR SUPPORTING AND POSITIONING PATIENTS

[76] Inventor: George S. Burnett, 935 Gossett Rd., Spartanburg, S.C. 29307

[21] Appl. No.: 100,069

[22] Filed: Jul. 29, 1993

Related U.S. Application Data

[63] Continuation of Ser. No. 920,608, Jul. 27, 1992, abandoned.

[51] Int. Cl.[5] ..... A61G 7/10

[52] U.S. Cl. ..... 5/85.1; 5/83.1

[58] Field of Search ..... 5/81.1, 83.1–89.1

[56] References Cited

U.S. PATENT DOCUMENTS

| | | | |
|---|---|---|---|
| 371,035 | 10/1887 | Crandall . | |
| 2,498,853 | 2/1950 | Hassold et al. . | |
| 2,939,195 | 6/1960 | Carlson . | |
| 2,990,899 | 7/1961 | DeBella | 5/83.1 X |
| 3,205,512 | 9/1965 | Camper | 5/86.1 |
| 3,386,111 | 6/1968 | Daniel . | |
| 3,530,851 | 9/1970 | Geschickter | 5/83.1 X |
| 3,574,871 | 4/1971 | Greene . | |
| 3,882,554 | 5/1975 | Glass . | |
| 3,905,055 | 9/1975 | Blair | 5/85.1 |
| 3,924,281 | 12/1975 | Gibbs . | |
| 4,195,375 | 4/1980 | Paul . | |
| 4,397,051 | 8/1983 | Wheeler . | |
| 4,649,581 | 3/1987 | Lee, Jr. . | |
| 4,688,304 | 8/1987 | Marcott . | |
| 4,843,665 | 7/1989 | Cockel et al. | 5/81.1 X |
| 5,005,233 | 4/1991 | Toivio et al. | 5/83.1 |

*Primary Examiner*—Michael F. Trettel
*Attorney, Agent, or Firm*—Dority & Manning

[57] ABSTRACT

A device for cooperating with a vertically movable bed for supporting and positioning patients is provided. The device comprises a frame adapted to be positioned along one side of the bed with one or more cross members extending over the bed. Flexible support means are supported on the cross member for connecting to a patient supporting means for supporting a portion of the anatomy of a patient. In one embodiment, the cross member is cantilevered from a vertical column on the frame, and in other embodiments frames extend along each side of the bed with vertical columns to support cross members on each end. In still another embodiment, at least two cross members are supported by four columns to provide means for supporting the torso of the patient completely.

16 Claims, 5 Drawing Sheets

DEVICE FOR SUPPORTING AND POSITIONING PATIENTS

This is a continuation of application U.S. Ser. No. 07/920,608, abandoned upon the filing hereof.

BACKGROUND

The present invention is a device for use in cooperation with vertically movable hospital beds to support human patients who are unable to move under their own power.

Patient lifts of various types are known in the art. Disadvantages of prior lifts include patient discomfort in the positioning of the device and the expense of manufacturing the apparatus. Most prior art lifting devices require the patient's body to be lifted and straps or other lifting support material to be placed under the patient's body. In such devices, the strap or supporting material is generally connected to overhead metal bars by chain supports. The devices lift and support the patient from a bed or wheelchair. The device itself has moving parts and most such devices employ hydraulic lifts for raising and lowering the metal bars supporting the straps or supporting material.

These prior art supports are expensive to manufacture, requiring complicated designs for assuring proper coordination and operation of the lifting mechanisms. Moreover, the placement of the straps or supporting materials under the portion of the patient's body to be lifted often requires several nurses or orderlies for first lifting or moving the patient and then for inserting the supporting material underneath. Such movement of the patient often causes pain and discomfort to the patient. Accordingly, means for allowing positioning of a patient without employing the complicated devices described above that is also economical and easy to operate is needed.

SUMMARY OF THE INVENTION

It is an object of the present invention to provide a means for supporting and positioning patients in cooperation with a vertically movable bed without requiring a mechanical lifting mechanism.

Another object of the present invention is to provide a patient supporting and positioning device that cooperates with a vertically movable bed to minimize the physical effort of the attendant or nurse caring for the patient.

Yet another object of the present invention is to provide a patient supporting and positioning device that is removable from its position alongside the patient's bed when not in operation.

It is still another object of the invention to provide a patient supporting and positioning device that can be easily disassembled for storage or transport and reassembled for use and which is also adjustable in length and width.

These and other objects and advantages, which shall hereinafter appear, are attained by the present invention for which, for purposes of illustration only and not for limitation, an exemplary embodiment of the present invention is illustrated in the accompanying drawings.

The present invention is used to support a patient in a predetermined position while a bed is moved vertically away from the patient to enable the patient to be turned or to be moved to another bed or the like. One embodiment of the invention permits one portion of the patient to be supported while the bed moves away to permit the insertion of a bed pan between the patient and the bed structure without requiring movement of the patient.

The present device does not lift or lower the patient, but merely maintains the patient in a predetermined position while a vertically movable bed is moved away from the patient. Generally speaking, the device includes a first frame adapted to be oppositely positioned along a first side of the bed where such first frame has a vertical column supported on a horizontal base extending alongside the bed. The device further includes a second frame adapted to be positioned along a second side of the bed opposite the first side where the second frame also has a vertical column supported on a horizontal base extending along the other side of the bed.

A cross member is adapted for extending between the oppositely positioned vertical columns of the first and second frames and over the bed and patient, who may be recumbent thereon. The device also includes at least two flexible support elements, with one end of each support element being pivotally mounted on the cross member at spaced apart positions, each of which is adjacent to one of the vertical columns.

A patient supporting means is provided for extending about a portion of the anatomy of the recumbent patient, and especially beneath the patient. The patent supporting means is connected along each side of the bed to the flexible support elements by suitable connection means. The device enables a portion of the anatomy of the patient to be maintained in its original position when the bed portion supporting that portion of the anatomy is lowered away from the patient. Use of the device permits the insertion of bed pans, patient supporting or turning wedges, or the like, under various portions of the patient's anatomy.

In one embodiment of the invention, the first and second frames each have at least two vertical columns with pivoting two cross beam attachments for supporting the patient at two points along his torso or anatomy. This permits the patient to be supported in his original position while the bed is moved vertically away to permit the patient's bed to be changed or the patient to be turned without the patient having to be manually moved.

The concept of the present invention resides in the avoidance of employing a hoist or other mechanism that actually lifts the patient from a resting point. Currently, lifters are used that have hydraulic cylinders, electric motors that pull cables, and the like. The present invention employs a supporting mechanism positioned above the patient that enables the patient to be maintained in position when the vertically movable bed supporting the patient is vertically lowered. Although the specific embodiments described herein show constructions having frame members for positioning alongside the bed, the invention defined herein is not to be limited to any particular construction. In basic terms, the invention is a supporting mechanism positioned above a patient wherein the supporting mechanism has a plurality of supporting elements extending toward the patient. Connecting means are carried on the supporting elements for connecting a portion of a patient supporting means, such as a bed sheet, to the supporting elements. When the connecting means are engaged, the bed may be vertically lowered and raised for lifting, turning, and moving the patient.

DETAILED DESCRIPTION OF THE INVENTION

Figure 1:
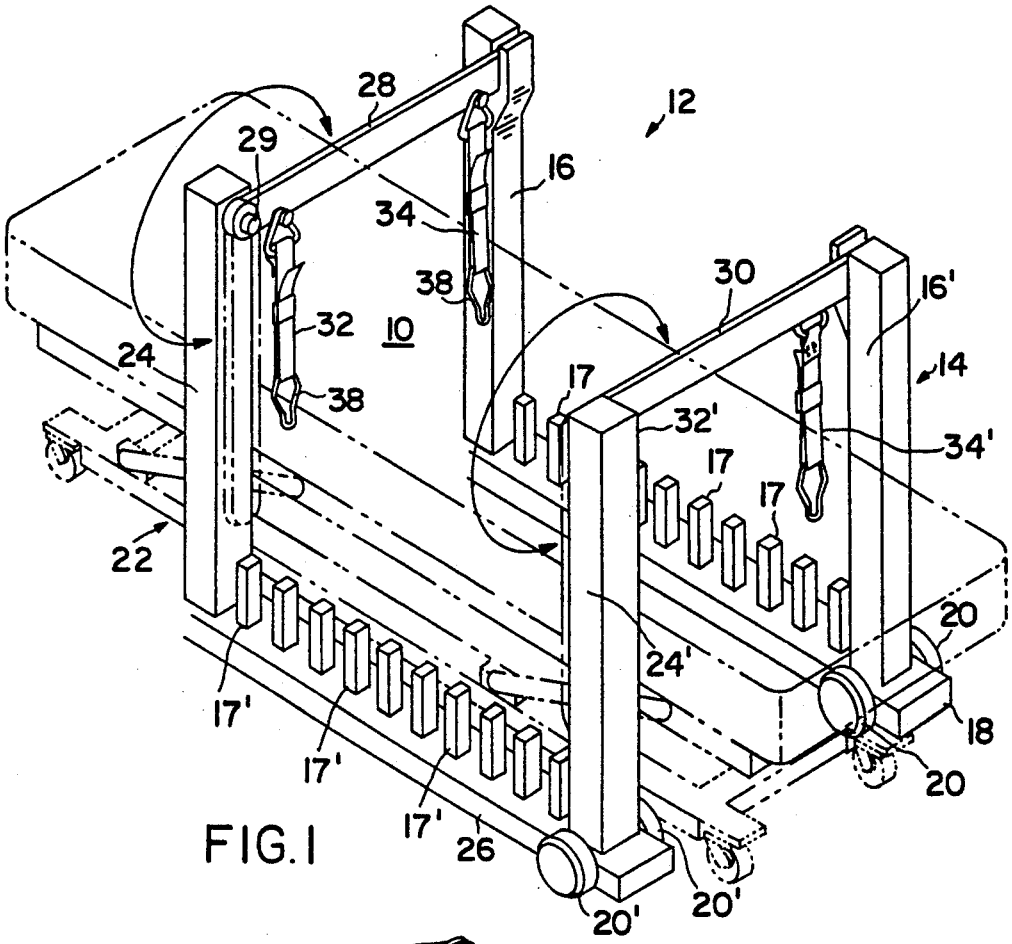
FIG. 1 is a perspective view of the present patient supporting and positioning device in association with a vertically movable hospital bed shown in cutaway portions.

Referring now to FIGS. 1–6 wherein a first embodiment of the invention is illustrated, a patient supporting and positioning device 12 comprises a first frame 14 adapted to be positioned along one side of a vertically-movable bed 10. First frame 14 comprises a plurality of vertical supports 17 on a horizontal base 18 for supporting removable vertical columns 16 and 16'. Vertical supports 17 are spaced along the horizontal base 18 at spaced distances to permit the length of supporting device 12 and, therefore, placement of flexible support elements 32, 32', 34 and 34' to be adjusted for patients of various heights. Vertical columns 16 and 16' are detachably supported on vertical supports 17 at the selected locations. Vertical columns 16 and 16' may be constructed of a lightweight metal and may be hollow for fitting over vertical supports 17. Horizontal base 18 may be supported by rollers 20 for rolling first frame 14 into position alongside bed 10.

A second frame 22 is adapted for positioning on the opposite side of bed 10 and comprises vertical columns 24 and 24' detachably mounted on vertical supports 17' carried on horizontal base 26 in the same manner described above with regard to first frame 14. Like first frame 14, second frame 22 may include rollers 20' for easily moving second frame 22 into position alongside bed 10.

A first cross member 28 is pivotally mounted as shown in phantom and with the circular arc in FIG. 1 about pivot 29 on vertical column 24. Cross member 28 is adapted to extend across bed 10 to be supported by column 16 on first frame 14. A second cross member 30 is pivotally mounted on vertical column 24' about pivot 31 and supported by vertical column 16' in the same manner as cross member 28.

Flexible support elements 32 and 32' are mounted on one end of first and second cross members 28 and 30, respectively, by pivots spaced adjacent to second frame 22. Flexible support elements 34 and 34' are mounted on the opposite end of first and second cross members 28 and 30, adjacent to first frame 14 in like fashion. In FIGS. 3–6 and 10, recumbent patient P is illustrated reclining on a bed 10 on a sheet 36. Each of the flexible support members 32, 32', 34, and 34' are connected to sheet 36 for supporting same.

Figure 2:
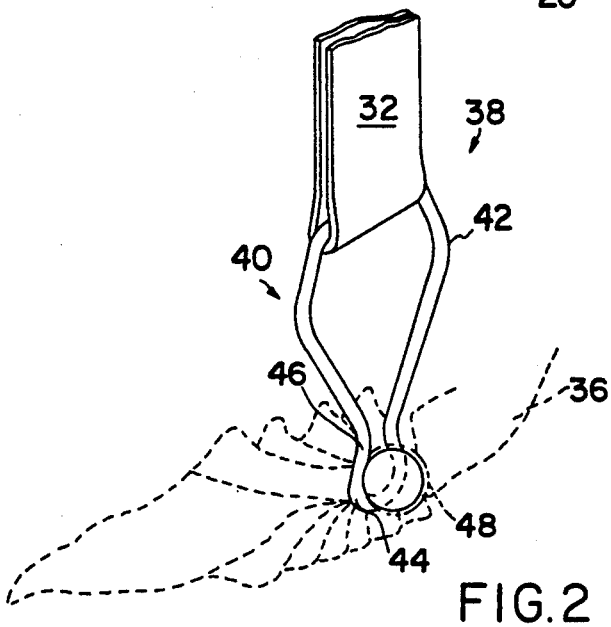
FIG. 2 is an enlarged view of the connection means between the patient supporting and positioning device and a sheet or other patient supporting means.

One means useful for connecting sheet 36 to cross members 28 and 30 is shown in FIG. 2. Flexible support element 32 terminates in a connecter 38 having a bowling pin-shaped metal ring 40 with a large end 42, a small end 44, and a narrow neck portion 46. To attach a corner of sheet 36 to this particular connecter 38, a hard rubber or plastic ball 48 is trapped in a corner or a portion of sheet 36, threaded through ring 40, and moved through the narrow neck portion 46 into small end 44. The ball is thereby securely held in connector 38 and sheet 36 is thus securely connected to the end of flexible support element 32 by such connecting means.

Ball 48 is selected to provide the proper degree of friction between itself and sheet 36. As discussed above, each of the flexible support members or elements in this embodiment is provided with a connector 38 as illustrated in FIG. 2. Therefore, sheet 36 is securely connected to flexible support elements 32, 32', 34, and 34' as seen in FIGS. 3–6 and 10. Although this particular connector means is useful in the present device, the invention is not limited thereto and any suitable means of connecting the patient supporting means to the flexible support elements may be used.

Figure 3:
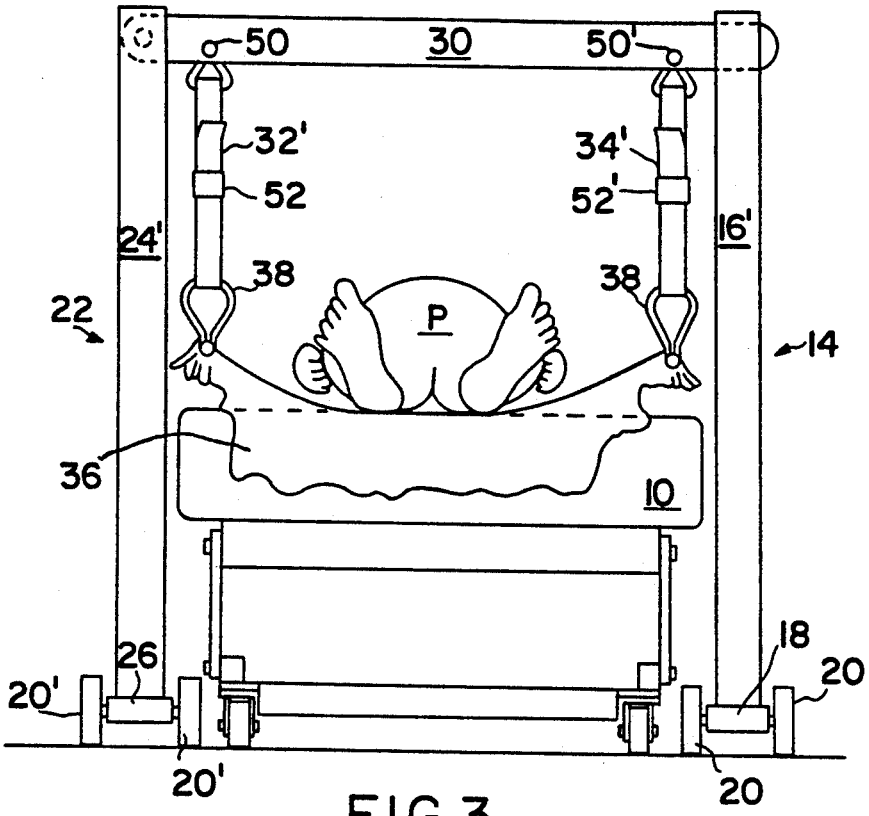
FIG. 3 is an end view of the patient supporting and positioning device showing a recumbent patient lying on a bed with the bed in a raised vertical position.
Figure 4:
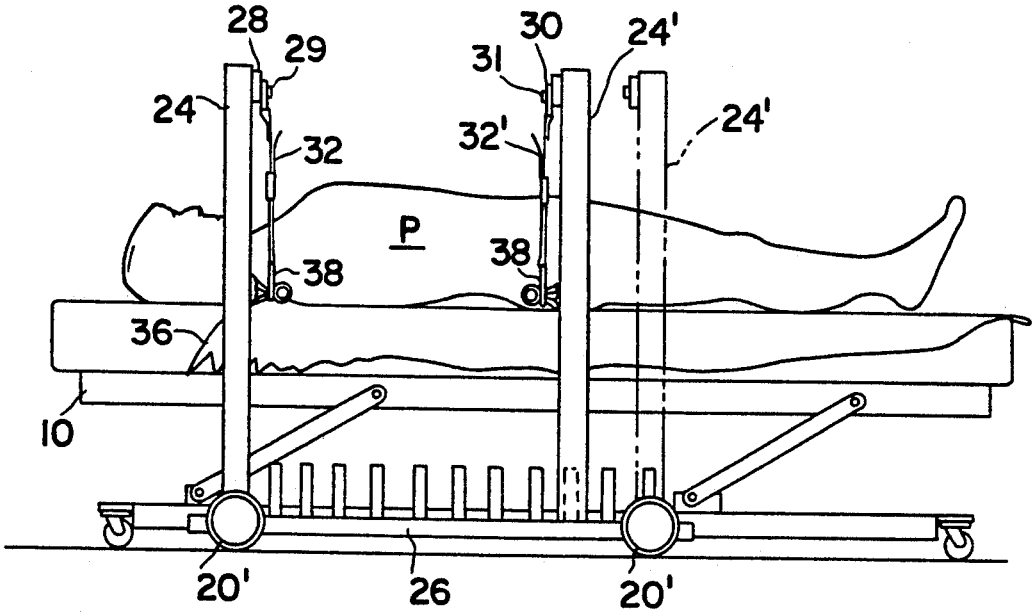
FIG. 4 is a side view of the patient supporting and positioning device shown in FIG. 3.

As best seen in FIG. 3, flexible support elements 32, 32', 34 and 34' are preferably, but not necessarily, provided with buckles 52, 52' which enable their lengths to be adjusted to suit the conditions necessary for handling the patient. Flexible support elements 32, 32', 34, and 34' may be belts, chains, straps or the like.

Figure 5:
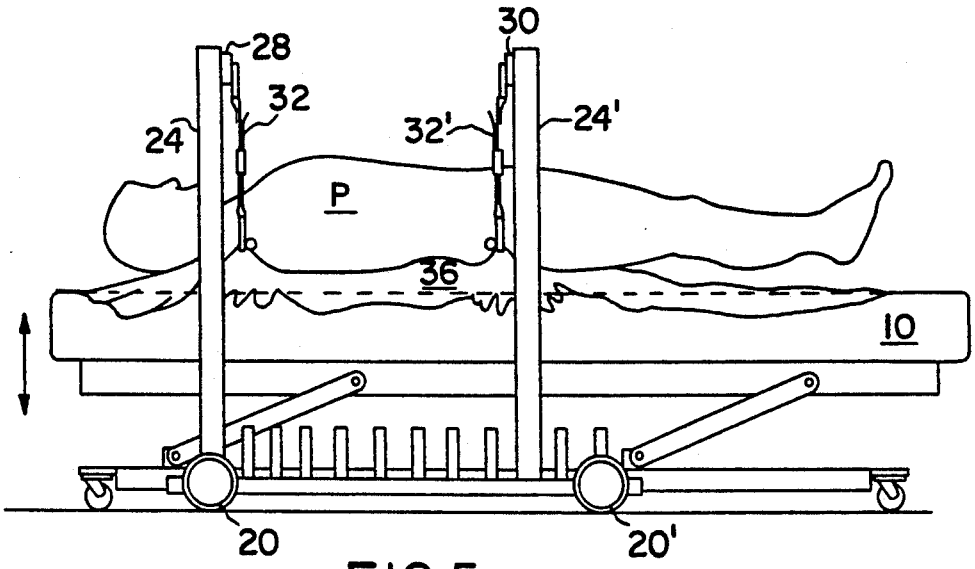
FIG. 5 is a view of the patient supporting and positioning device shown in FIG. 4 showing supporting of the patient by the patient supporting and positioning device when the bed is in a lowered vertical position.
Figure 6:
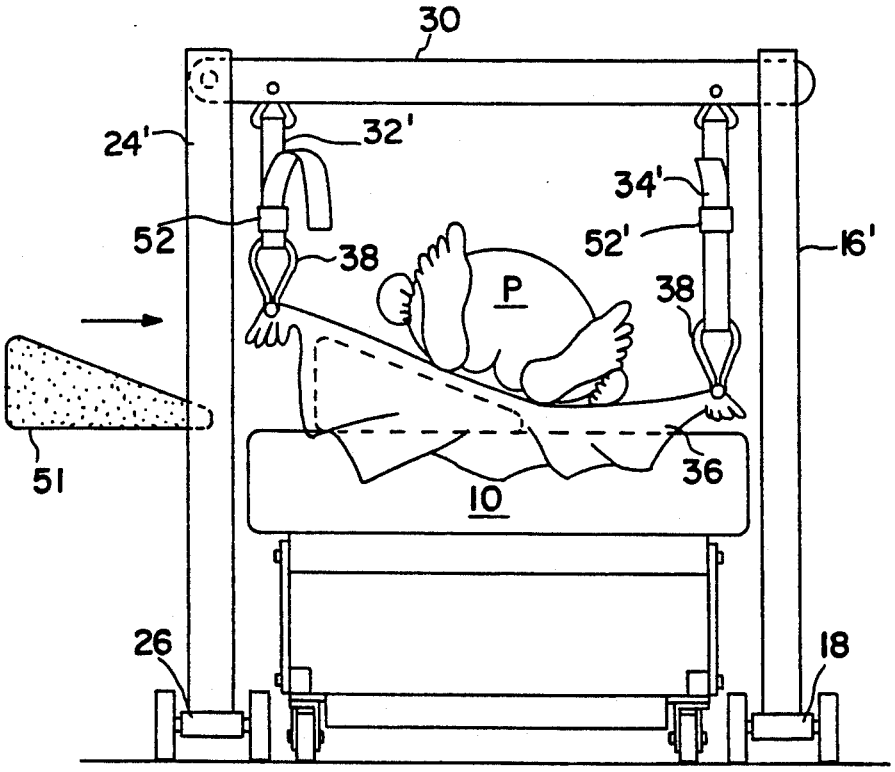
FIG. 6 is an end view of the patient supporting and positioning device illustrated in FIG. 5 when used to turn the patient and insert a foam wedge under a portion of the patient's body.

As seen in FIG. 5, the patient is supported by sheet 36 when bed 10 is vertically lowered. The device allows the attendant to change the linen on the bed, except for sheet 36, change beds, move the patient, or turn the patient onto his side or stomach as seen in FIG. 6. Thus, the supporting device 12 securely supports the patient after bed 10 is vertically lowered without creating an undue strain on the patient or the nursing staff and without employing complicated lifting devices. Moreover, the presence of the bed under the supporting mechanism ensures that patient will not be injured should the supports fail.

When it is desired to use the supporting and positioning device 12 for turning the patient onto his side or stomach, one set of flexible elements 32 and 32' or 34 and 34' may be shortened while the patient is in the recumbent position on the bed. As seen in FIG. 6, when bed 10 is lowered vertically after such adjusting, one side of sheet 36 is supported at a higher level by elements 32 and 32' than the side of sheet 36 supported by elements 34 and 34' on the opposite side of the bed. The patient will tend to roll over onto his side, if desired.

Further-more, a wedge 51 may be used as shown to assist in facilitating turning of the patient.

As seen in the accompanying figures, the patient supporting and positioning device 12 is easily movable into position alongside any bed. The parts, specifically vertical columns 16, 16', 24, and 24', are removable from horizontal bases 18 and 26. Moreover, flexible supporting elements 32, 32', 34, and 34' are detachable from cross members 28 and 30. Cross members 28 and 30, of course, may be disengaged from vertical columns 16 and 16' and pivoted into a vertical aligning position on vertical columns 24 and 24' as shown in phantom in FIG. 1. The patient supporting and positioning device 12 may, thus, be sufficiently broken down for easy storage, even in cramped quarters.

In addition, the rolling capability of frames 14 and 22 allows for exact positioning of the side-by-side supporting members on either side of the patient's bed. Moreover, the plurality of vertical supports 17 allows for complete adjustability of the spacing between vertical columns 24 and 24' and between vertical columns 16 and 16' as shown in phantom in FIG. 4 so as to compensate for differences in patients' lengths. The adjustability of flexible supporting elements 32, 32', 34 and 34' allow for the above-described turning and positioning of the patient as well as for use with beds having different vertical raising and lowering capabilities. Overall, the design of the present patient supporting and positioning device allows for easy and economical manufacture and low serviceability requirements due to the absence of any complicated lifting mechanisms. It will be appreciated that in the present device, the existing lowering and raising mechanism of bed 10 is used to lift and position the patient instead of using a separate free-standing lifting mechanism on the supporting and positioning device.

Figure 7:
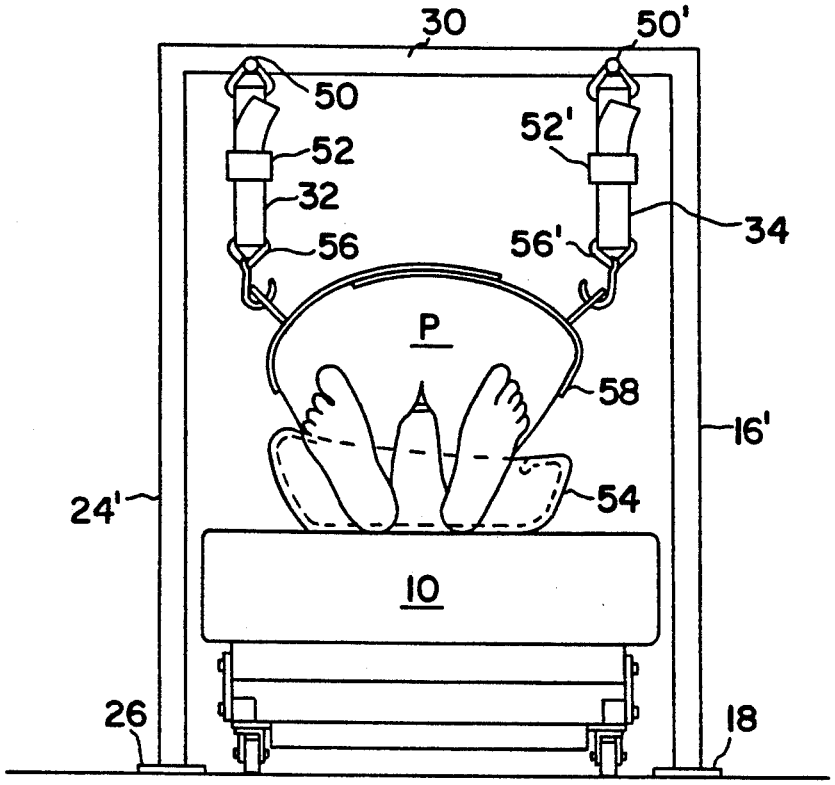
FIG. 7 illustrates an end view of a second embodiment of the invention for supporting the lower portion of a patient's anatomy when only the part of the bed supporting that portion of the patient's anatomy is lowered to provide access for a bed pan.
Figure 8:
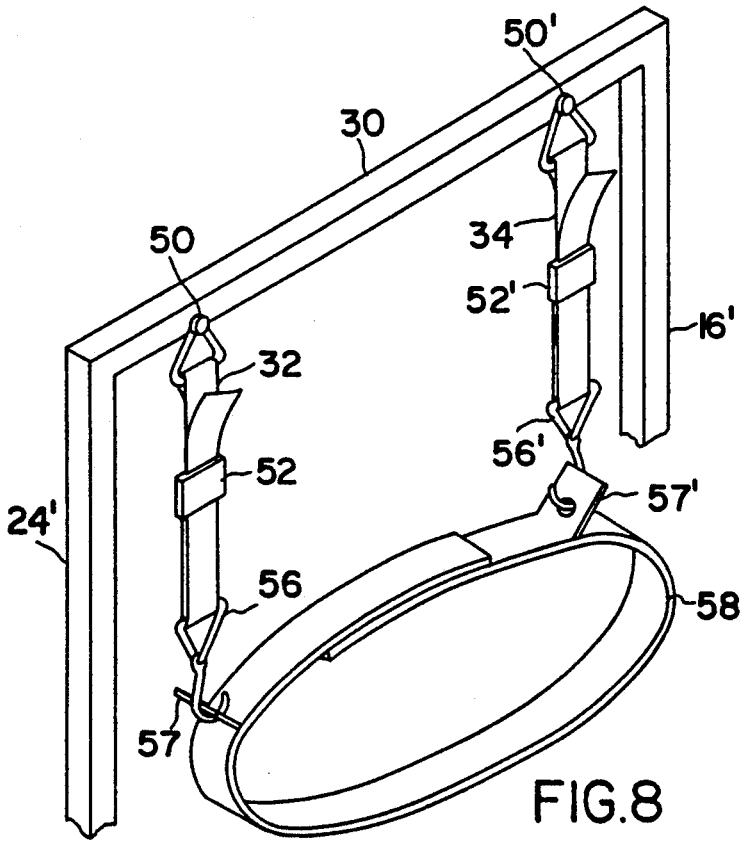
FIG. 8 is a perspective view of the embodiment illustrated in FIG. 7.

In a second embodiment illustrated in FIGS. 7 and 8, vertical columns 16' and 24' are supported on base members 18 and 26, respectively, which lie along opposite sides of bed 10. A cross member 30 extends across the tops of vertical columns 16' and 24'. Flexible support elements 32 and 34, as previously described, are pivotally mounted about pivots 50 and 50' on cross member 30. A patient supporting means such as support strap 58, which is adapted to extend about a single portion of the patient's anatomy, mainly the hips of the patient, facilitates insertion of a bed pan under the patient using this particular embodiment. Support strap 58 may be wrapped and secured around the patient's body by a velcro or other attachment. The support strap 58 may be attached to the ends of flexible support elements 32' and 34' by hooks 56 and 56' which engage openings in ends 57 and 57' of support strap 58 to support only a single portion of the patient's anatomy.

As seen in FIG. 7, the buttocks of the patient are suspended when bed 10 is moved vertically away from the buttocks and bed pan 54 may be easily inserted between the patient and bed 10. After such insertion, bed 10 is raised to bring the bed pan into the proper position beneath the patient. In this embodiment, only a single vertical column on each side of the bed is required to support the portion of the patient's anatomy. Of course, two vertical columns on each side of bed 10 could be employed in this embodiment.

In this particular embodiment, the rolling horizontal base members previously described are also not necessary. The vertical columns 24' and 16' and cross member 30 may be made together in a one-piece construction of lightweight material. The supporting member may be moved into position above the patient and bed easily due to its lightweight construction. It will be appreciated, however, that various forms and designs of the present embodiment may be made according to the present invention.

Figure 9:
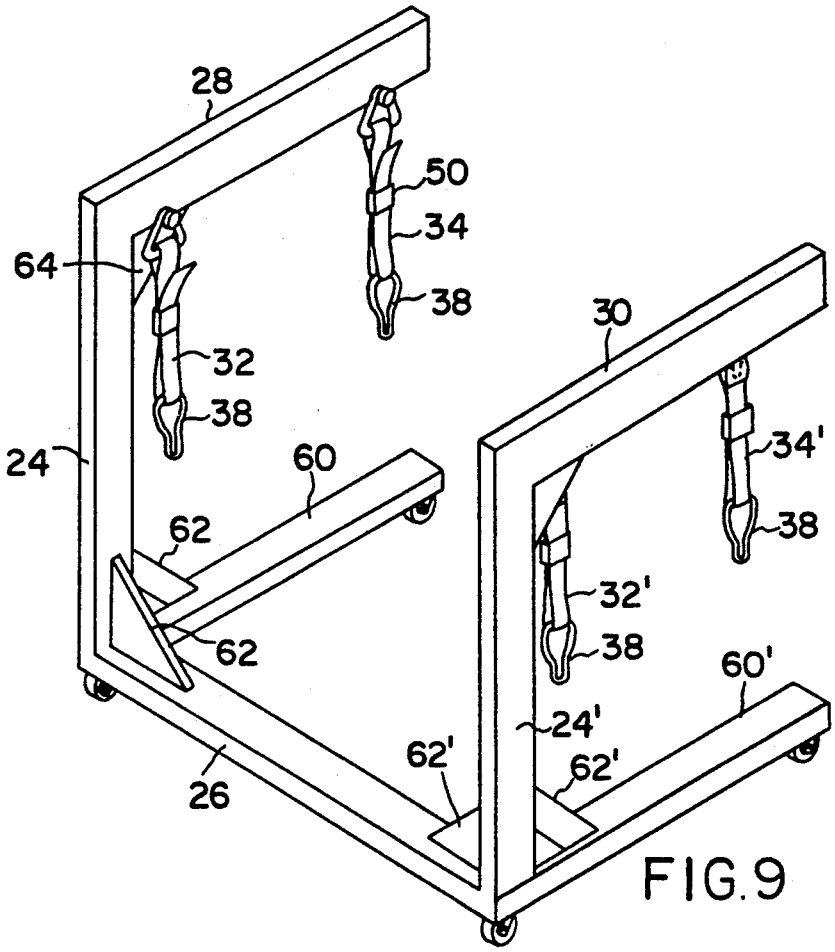
FIG. 9 is a perspective view of a third embodiment of the invention.
Figure 10:
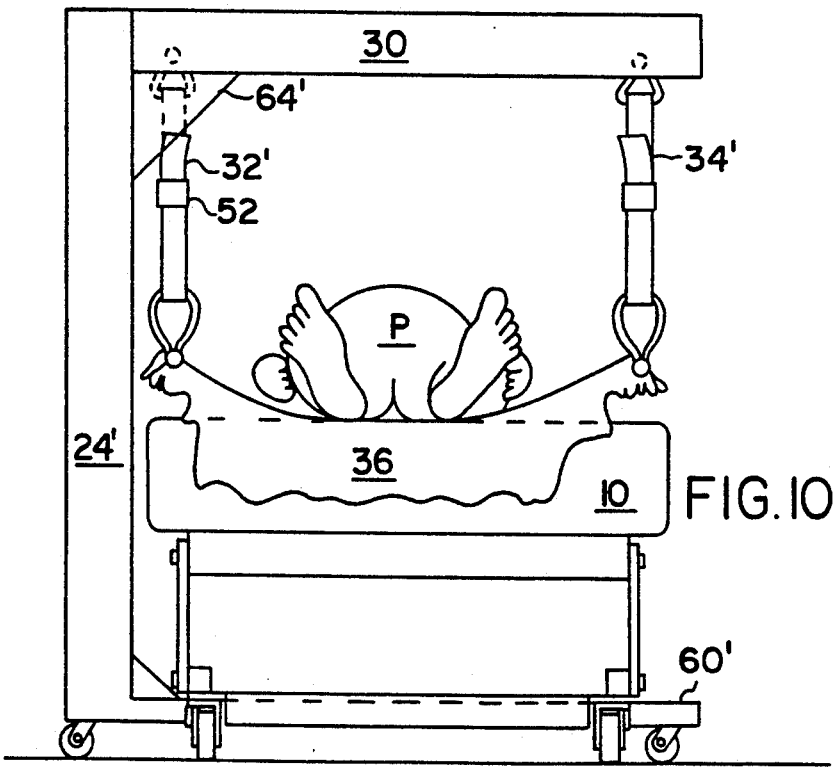
FIG. 10 is an end view of the embodiment shown in FIG. 9 illustrating its usage to support a recumbent patient on a hospital bed, Repeat use of reference characters in the present specification and drawings is intended to represent the same or analogous features or elements of the invention.

Referring now to FIGS. 9 and 10 wherein a third embodiment of the invention is illustrated, FIG. 10 illustrates a cantilevered type of frame for supporting cross members 28 and 30. This embodiment comprises a horizontal base 26 with support members 60 and 60' adapted to extend beneath the hospital bed as best seen in FIG. 10. A pair of vertical columns 24 and 24' are supported on base 26 by support column braces 62 and 62'. Cross members 28 and 30 are supported by cross member braces 64 and 64' and extend in cantilever fashion over the hospital bed when the frame is brought alongside of the hospital bed as seen in FIG. 10.

In this embodiment, a sheet 36 may be fastened to the ends of flexible elements 32, 32', 34 and 34' as described hereinabove with regard to FIGS. 1–6 so that the patient may be supported in the same manner as described.

Any of the various embodiments of the patient supporting and positioning device described may be constructed from material suitable for such devices. Among those materials include lightweight aluminum, steel, iron, plastics, and the like. The devices may be made by casting, molding, welding parts together, or any other suitable means which are well known in the art.

It will be understood that the invention is not limited to the particular patient supporting and positioning devices described herein nor any particular dimensions therefor. It should also be understood that any patient supporting and positioning device equivalent to that described herein falls within the scope of the present invention. The embodiments described herein are merely exemplary so as to enable one of ordinary skill in the art to make and use the patient supporting and positioning devices. It will also be understood that while the form of the invention shown and described herein constitutes a preferred embodiment of the invention, this description is not intended to illustrate all possible forms of the invention. The words used are words of description rather than of limitation. Various changes and variations may be made to the present invention without departing from the spirit and scope of the following claims.

What is claimed is:

1. A device for cooperating with a vertically movable bed for supporting and positioning patients comprising:

a) a first frame adapted to be positioned adjacent a first side of said bed, said first frame comprising a horizontal base having vertical columns extending from said horizontal base;

b) a second frame adapted to be positioned along an opposite side of said bed, said second frame comprising a horizontal base having vertical columns extending from said horizontal base;

c) a cross member extending between and supported by said vertical columns extending from said first and said second frames, said cross-member extending over said bed and over any patient reclining on said bed when said first and second frames are positioned adjacent and on opposite sides of said bed;

d) at least two flexible support elements attached to said cross member;

e) a patient supporting means for extending about a portion of the anatomy of a patient; and f) connecting means for connecting a portion of said patient supporting means to an end of said flexible support elements for supporting a portion of said patient's anatomy when said bed is vertically lowered.

2. The supporting and positioning device as set forth in claim 1 wherein said cross member is pivotally attached to one of said vertical columns.

3. The supporting and positioning device as set forth in claim 1 wherein said patient supporting means comprises a sheet on said bed.

4. The supporting and positioning device as set forth an claim 1 wherein said patient supporting means comprises a flexible member adapted to extend about a portion of the patient's anatomy.

5. A device for cooperating with a vertically movable bed for supporting and positioning patients comprising:

a) a first frame adapted to be positioned adjacent one side of said bed, said first frame comprising at least two vertical columns adjustably and detachably mounted on a horizontal base member;

b) a second frame adapted to be positioned adjacent to an opposite side of said bed, said second frame having at least two vertical columns adjustably and detachably mounted on a horizontal base member;

c) at least two cross members for extending between and being supported by said vertical columns when said first frame and said second frame are aligned so that said vertical columns on said first and second frame are in alignment;

d) a first pair of flexible support elements pivotally disposed and spaced on one of said cross members and another pair of flexible support members pivotally disposed and spaced on another of said cross members, said flexible support elements being disposed adjacent to said vertical columns supporting said cross members; and e) connecting means disposed on an end of each of said flexible support elements for connecting said flexible support elements to a sheet of flexible material for supporting a patient reclining on said sheet when said bed is vertically lowered.

6. A device for cooperating with a vertically movable bed for supporting and positioning patients comprising:

a) a frame for positioning adjacent to said bed, said frame comprising a horizontal base member, said frame further comprising a plurality of vertical columns supported and adjustably spaced on said horizontal base member;

b) cross members attached to said vertical columns for positioning over said bed and over any recumbent patient reclined on said bed when said frame is positioned adjacent said bed;

c) patient supporting means for extending about a portion of the anatomy of a patient reclined on said bed;

d) flexible supporting elements attached to said cross member for supporting said supporting means when said bed is vertically lowered;

e) first connecting means for connecting a first portion of said patient supporting means to said cross member wherein said first connecting means is adjacent to one side of said bed; and f) second connecting means for connecting a second portion of said patient supporting means to said cross member at a point spaced from where said first connecting means is connected to said cross member adjacent to the other side of said bed for supporting a portion of said patient's anatomy when said bed is lowered vertically.

7. The supporting and positioning device as set forth in claim 6 wherein said cross members are supportable over said bed by vertical columns carried by a second frame.

8. The supporting and positioning device as set forth in claim 7 wherein said patient supporting means comprises a sheet on said bed.

9. The supporting and positioning device as set forth in claim 7 wherein said cross members are pivotally attached to half of said vertical columns and removably supportable by the other half of said vertical columns.

10. The supporting and positioning device set forth in claim 6 wherein each of said cross members is supported on only one end by said vertical columns and extends over said bed.

11. A device for cooperating with a vertically movable bed for supporting and positioning patients comprising:

a) a first frame and a second frame adapted to be positioned along opposite sides of said bed, each of said first and second frames comprising a horizontal base member and a plurality of opposed vertical columns;

b) a cross member supported by upper ends of each of said opposed vertical columns for extending over said bed and over any recumbent patient reclined on said bed when said first and second frames are positioned adjacent said bed;

c) patient supporting means for extending about a portion of the anatomy of a patient reclined on said bed;

d) flexible supporting elements attached to said cross member for supporting said supporting means when said bed is vertically lowered;

e) first connecting means for connecting a first portion of said patient supporting means to said cross member wherein said first connecting means is adjacent to one side of said bed; and f) a second connecting means for connecting a second portion of said patient supporting means to said cross member at a point spaced from where said first connecting means is connected to said cross member adjacent to the other side of said bed for supporting a portion of said patient's anatomy when said bed is lowered vertically.

12. The supporting and positioning device as set forth in claim 11 wherein said patient supporting means comprises a sheet on said bed.

13. The supporting and positioning device as set forth in claim 11 wherein said vertical columns are adjustably spaced on said horizontal base members.

14. A device for cooperating with a vertically movable bed for supporting and positioning patients comprising:

a) a frame for positioning adjacent to said bed, said frame comprising a first vertical column positionable adjacent one long side of said bed and a second vertical column positionable adjacent the opposite long side of said bed, said frame further comprising a cross member immovably supported adjacent opposing ends thereof by said first and said second vertical columns for positioning over said bed and over any recumbent patient reclined on said bed when said frame is positioned adjacent said bed;

b) patient supporting means for extending around a portion of the anatomy of a patient reclined on said bed; and c) connecting means for connecting said patient supporting means to said cross member, said connecting means being connected directly to said cross member and having a fixed length relative to said cross member during lowering and raising of said bed so that said portion of said patient's anatomy remains stationary when said bed is lowered vertically, said connecting means being adjustable in length relative to said cross member so that said patient supporting and positioning device can be employed with beds having various heights.

15. The supporting and positioning device as set forth in claim 14 wherein said patient supporting means comprises a flexible belt for placing around a portion of said patient's anatomy.

16. A device for cooperating with a vertically movable bed for supporting and positioning patients during placement and removal of a bed pan between said patient and said bed comprising:

a) a stand-alone portable frame for positioning adjacent said bed, said frame comprising a first vertical column positionable adjacent one long side of said bed and a second vertical column positionable adjacent the opposite long side of said bed;

b) a cross member supported on its end by said first and said second vertical columns so that said cross member may be positioned over said bed and across any recumbent patient reclined on said bed when said frame is positioned adjacent said bed;

c) a flexible belt for placing around a portion of the anatomy of said patient;

d) flexible supporting means connected directly to said cross member in a fixed length relative to said cross member during lowering and raising of said bed so that said flexible belt is stationarily supported when said bed is vertically lowered; and e) connecting means for connecting said flexible belt to said flexible supporting means so that a portion of said patient's anatomy may be supported when said bed is lowered vertically.

* * * * *